US009194679B2

(12) United States Patent
Orozco et al.

(10) Patent No.: US 9,194,679 B2
(45) Date of Patent: Nov. 24, 2015

(54) MAGAZINE HOLDER

(71) Applicant: Tactical Safety Systems LLC, Grandview, MO (US)

(72) Inventors: Xander Orozco, Grandview, MO (US); Louis Orozco, Grandview, MO (US); Zico Orozco, Grandview, MO (US)

(73) Assignee: Tactical Safety Systems, LLC, Grandview, MO (US)

( * ) Notice: Subject to any disclaimer, the term of this patent is extended or adjusted under 35 U.S.C. 154(b) by 80 days.

(21) Appl. No.: 13/835,928

(22) Filed: Mar. 15, 2013

(65) Prior Publication Data

US 2014/0262892 A1 Sep. 18, 2014

(51) Int. Cl.
*F42B 39/00* (2006.01)
*F42B 39/02* (2006.01)

(52) U.S. Cl.
CPC ..... *F42B 39/02* (2013.01)

(58) Field of Classification Search
CPC ..... F42B 39/02; F42B 39/021; A45F 3/08; A45F 3/14; A45F 2003/144; A45F 5/02; Y10S 224/931
USPC ..... 206/3, 424, 1.5, 753, 756, 722, 443, 206/488; 224/666–670, 931, 269, 268, 239, 224/245, 242; 221/8, 74
See application file for complete search history.

(56) References Cited

U.S. PATENT DOCUMENTS

| | | | | | |
|---|---|---|---|---|---|
| 1,756,677 | A * | 4/1930 | Cook | ..... | 224/245 |
| 5,152,442 | A * | 10/1992 | Gallagher | ..... | 224/245 |
| 6,202,908 | B1 * | 3/2001 | Groover | ..... | 224/239 |
| 2004/0245304 | A1 * | 12/2004 | Cragg | ..... | 224/648 |
| 2008/0257929 | A1 * | 10/2008 | Cragg | ..... | 224/649 |
| 2008/0277436 | A1 * | 11/2008 | Wilson | ..... | 224/239 |

OTHER PUBLICATIONS

SKD Tactical, LLC. Esstac 762 KYWI (Kydex Wedge Insert) (comments dated Mar. 30, 2012) at http://www.skdtac.com/Esstac-762KYWI-Kydex-Wedge-Insert-p/ess.214.htm.

SKD Tactical, LLC. Esstac 762 KYWI Double Mag Pouch (comments dated Mar. 15, 2012) at http://www.skdtac.com/Esstac-762-Double-Wedge-Mag-Pouch-w-KYWI-p/ess222.htm.

* cited by examiner

*Primary Examiner* — Chun Cheung
(74) *Attorney, Agent, or Firm* — Hovey Williams LLP

(57) ABSTRACT

A magazine holder is operable to hold a small arms magazine and includes a magazine pouch and a shiftable gripping element. The magazine pouch presents an elongated pouch slot operable to receive at least part of the magazine when the magazine pouch holds the magazine. The gripping element is mounted on the magazine pouch to engage the held magazine.

19 Claims, 9 Drawing Sheets

MAGAZINE HOLDER

BACKGROUND

1. Field

The present invention relates generally to a magazine holder that supports a small arms magazine. More specifically, embodiments of the present invention concern a magazine holder with a pouch and an expandable clip.

2. Discussion of Prior Art

Turning to FIGS. 1-4, it is known in the art to carry one or more small arms magazines M in a magazine pouch P. The pouch P is typically carried by a wearer on a belt, bandolier, suspenders, girdle, an equipment pack, or similar structure. The conventional magazine pouch P includes a pair of side-by-side pouches that each present a slot S to receive a magazine M. The pouch P also includes elastic straps T that extend over the corresponding slot S to hold the magazine M in the slot S. The straps T can be flexed out of the holding position to allow removal of the magazine M.

However, the prior art magazine pouch P has various deficiencies. For instance, the elastic straps T used to hold the magazine M in the pouch P are prone to failure. Also, with the strap T removed from engagement with the magazine M, the magazine M tends to fall out of the pouch P, particularly when the wearer carries the pouch P while shifting rapidly. For instance, the magazine M tends to fall out when the wearer is rapidly running, jumping, falling, tumbling, rolling, etc.

SUMMARY

The following brief summary is provided to indicate the nature of the subject matter disclosed herein. While certain aspects of the present invention are described below, the summary is not intended to limit the scope of the present invention.

A first aspect of the present invention concerns a magazine holder operable to hold a small arms magazine. The magazine holder broadly includes a magazine pouch and a shiftable gripping element. The magazine pouch presents an elongated pouch slot operable to receive at least part of the magazine when the magazine pouch holds the magazine, with the magazine pouch being operable to extend at least partly around the held magazine. The shiftable gripping element is mounted on the magazine pouch to engage the held magazine in a holding condition. The magazine holder presents opposite gripping surfaces that extend along opposite sides of the pouch slot to contact the held magazine in the holding condition. The gripping element urges at least one of the gripping surfaces against the held magazine in the holding condition so that the gripping surfaces cooperatively grip the magazine.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Preferred embodiments of the invention are described in detail below with reference to the attached drawing figures, wherein.

Figure 1:
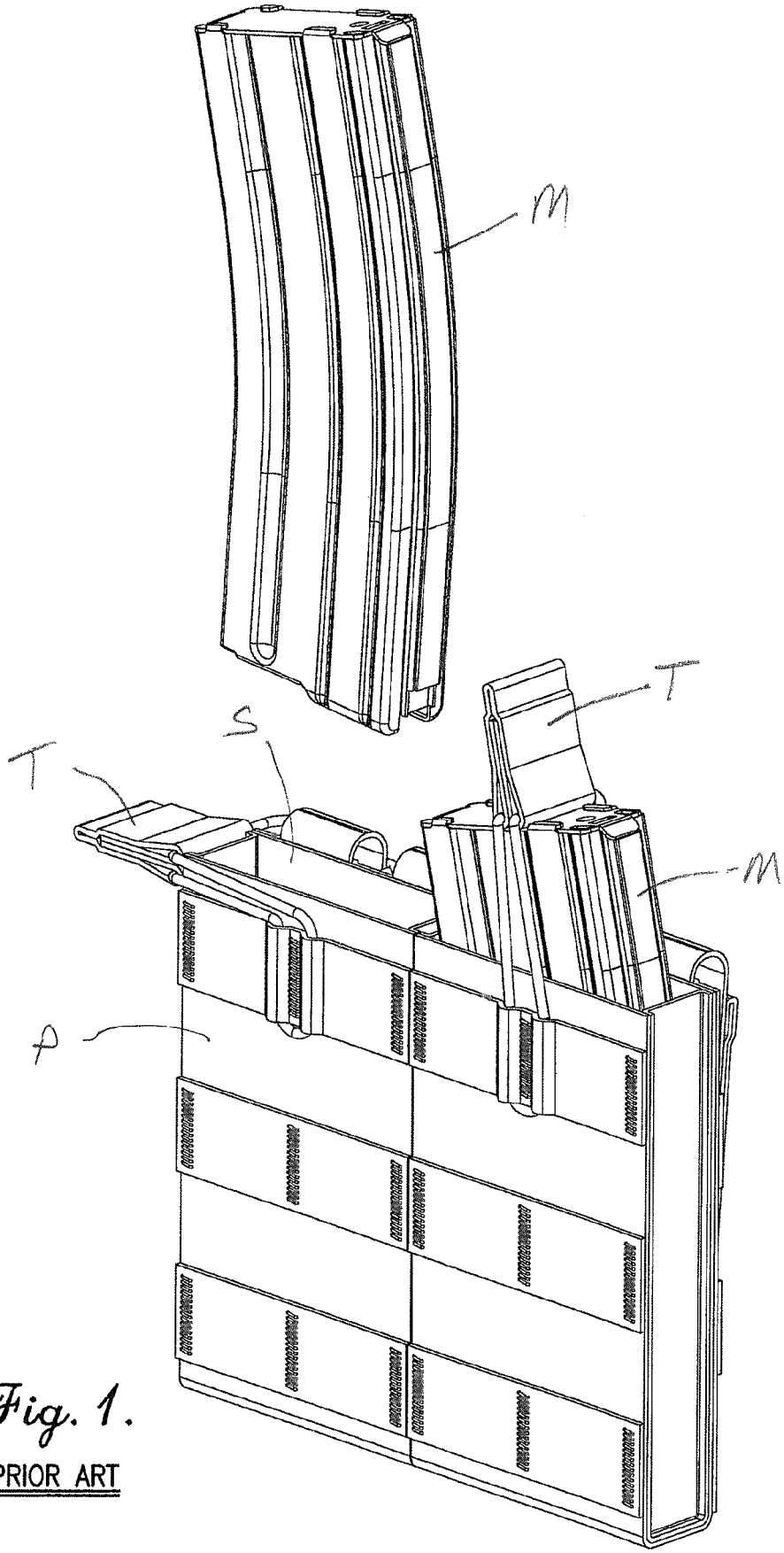
Fig. 1. PRIOR ART
FIG. 1 is a front perspective of a prior art magazine assembly including a magazine pouch and a pair of magazine operable to hold rounds of ammunition, with one of the magazines removed from the pouch and the other magazine secured in the pouch with a resilient strap.
Figure 2:
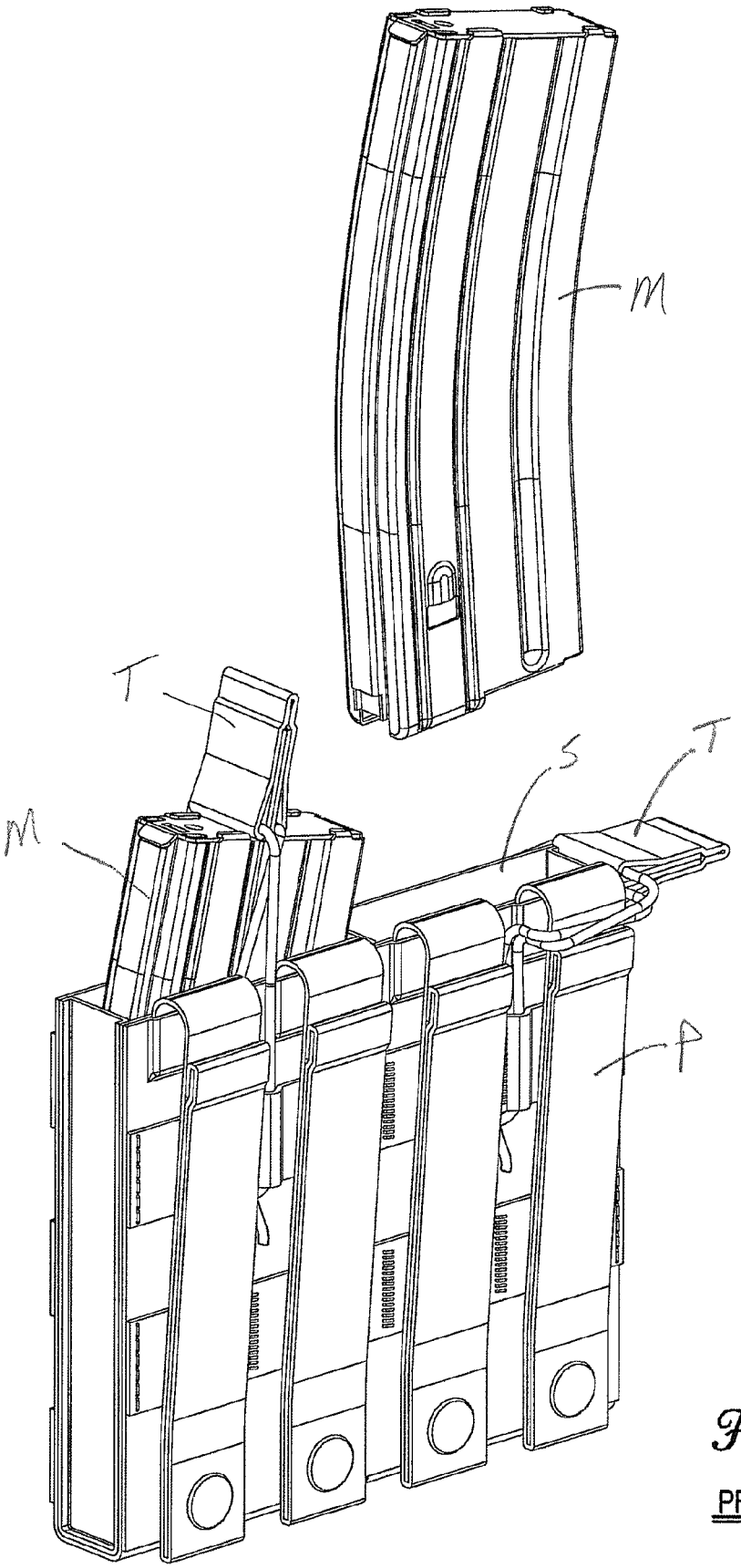
Fig. 2. PRIOR ART
FIG. 2 is a rear perspective of the prior art magazine assembly shown in FIG. 1.
Figure 3:
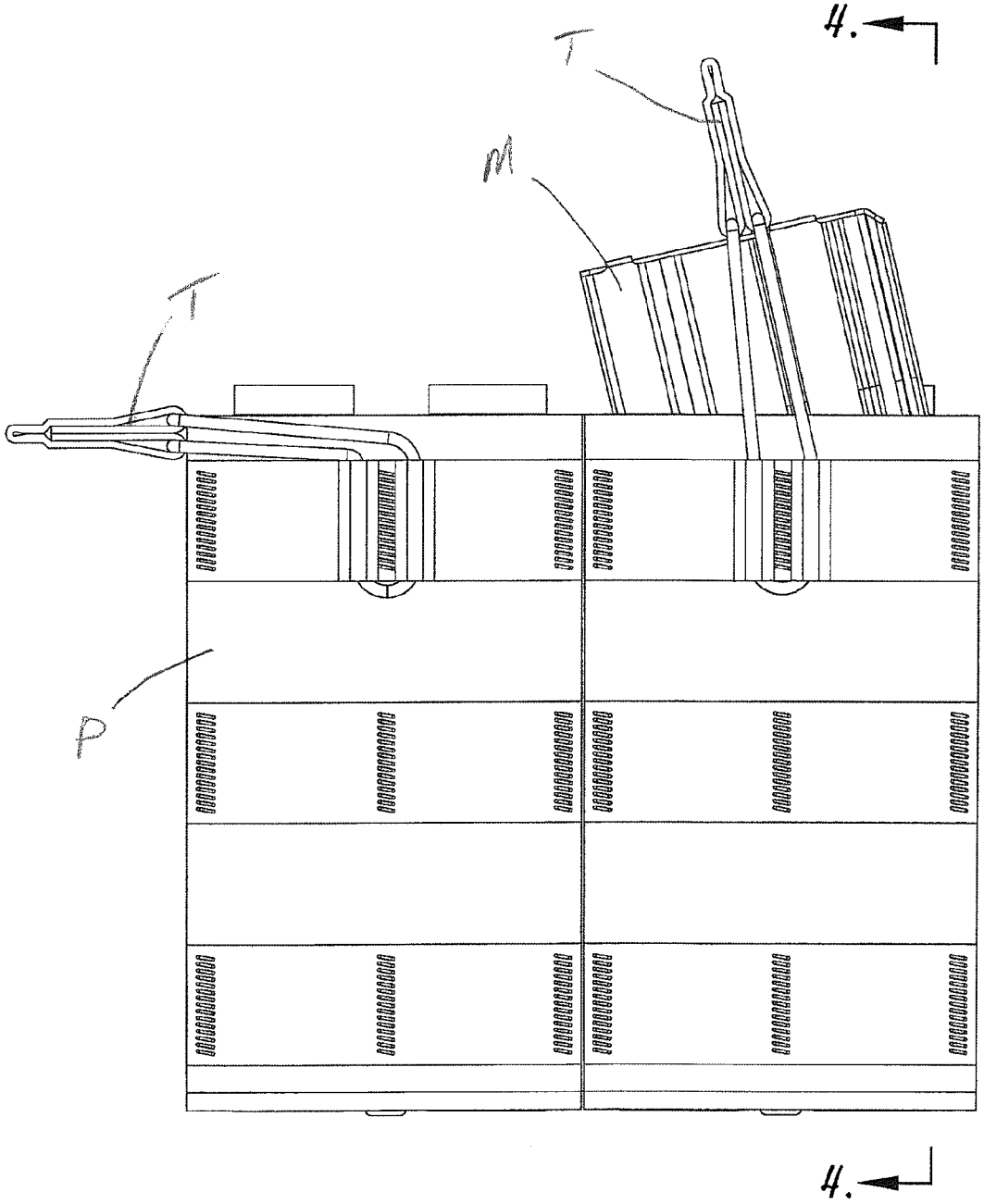
Fig. 3. PRIOR ART
FIG. 3 is a front elevation of the prior art magazine assembly shown in FIGS. 1 and 2.
Figure 4:
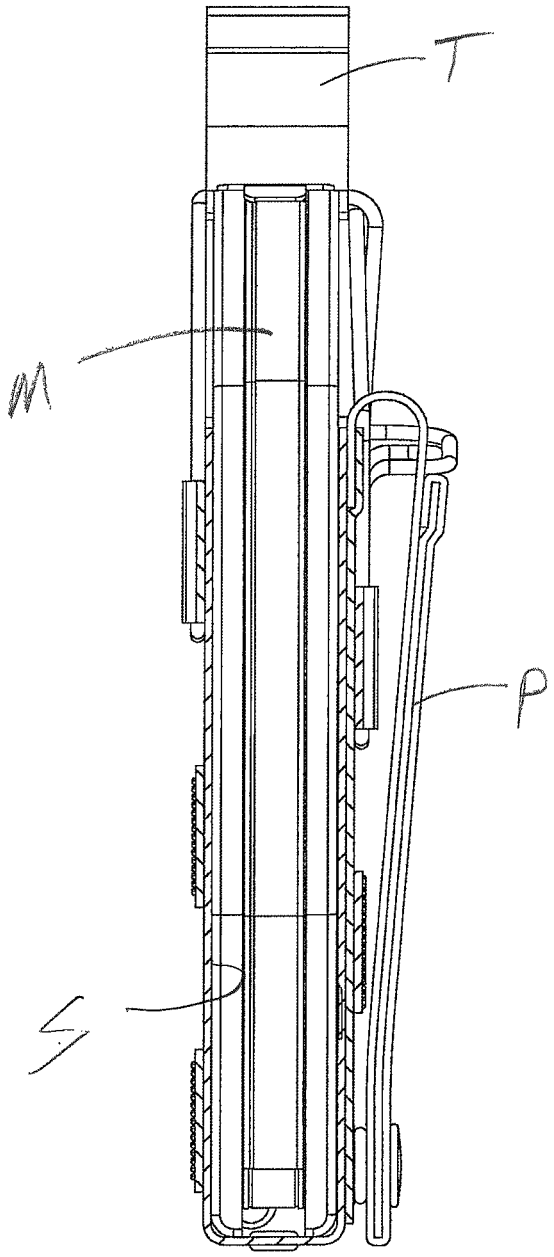
Fig. 4. PRIOR ART
FIG. 4 is a cross section of the prior art magazine assembly taken along line 4-4 in FIG. 3.
Figure 5:
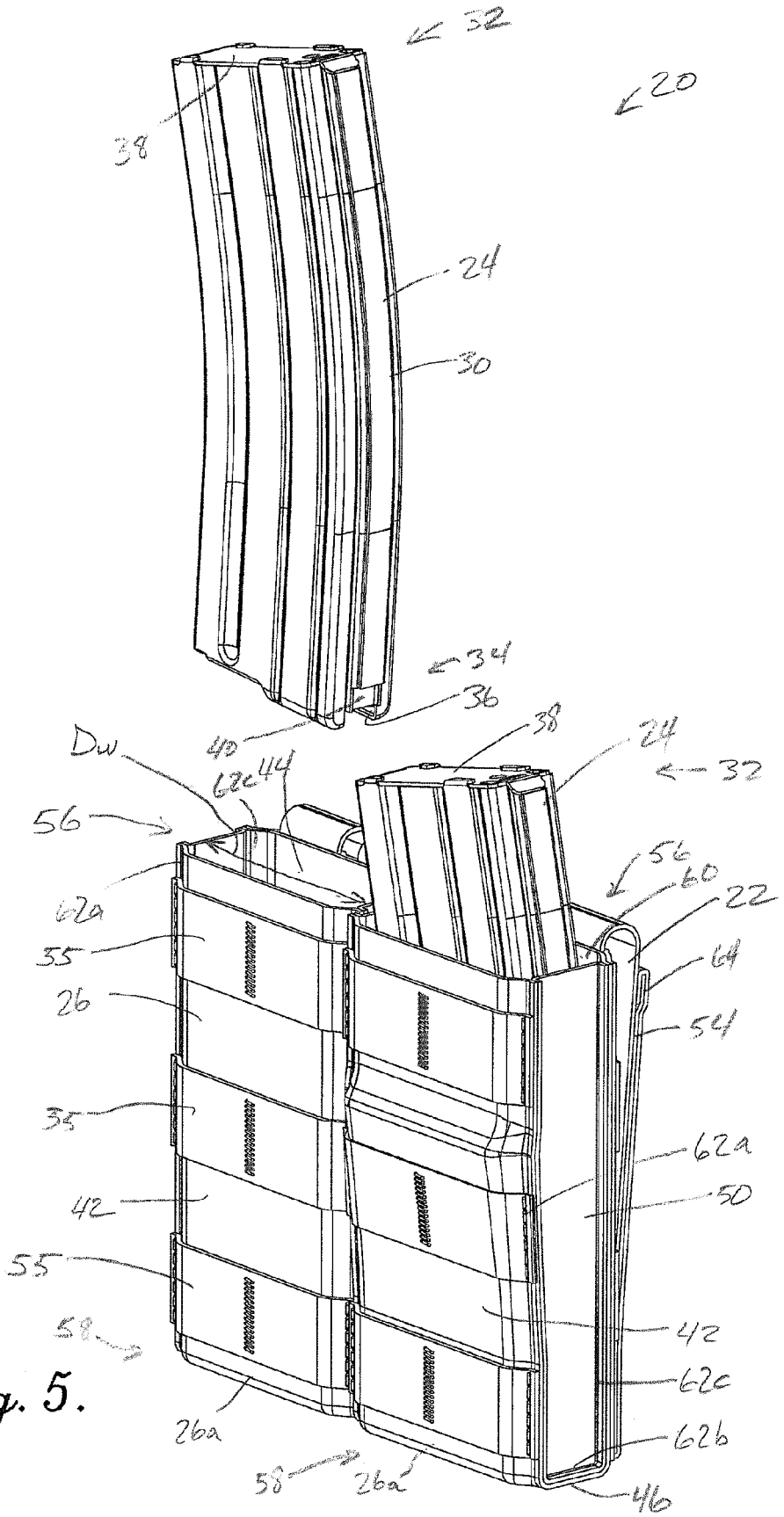
Figure 6:
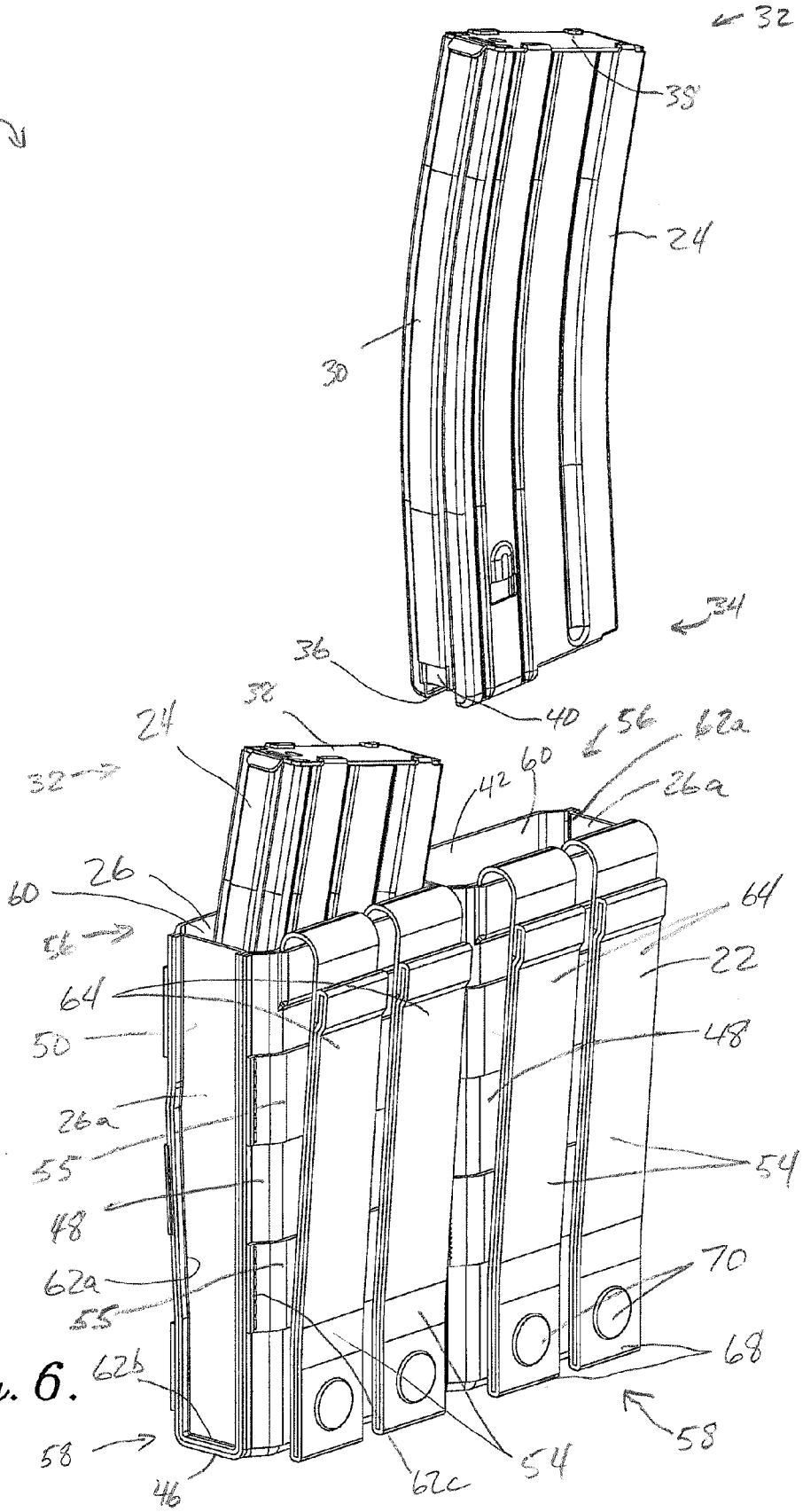
Figure 7:
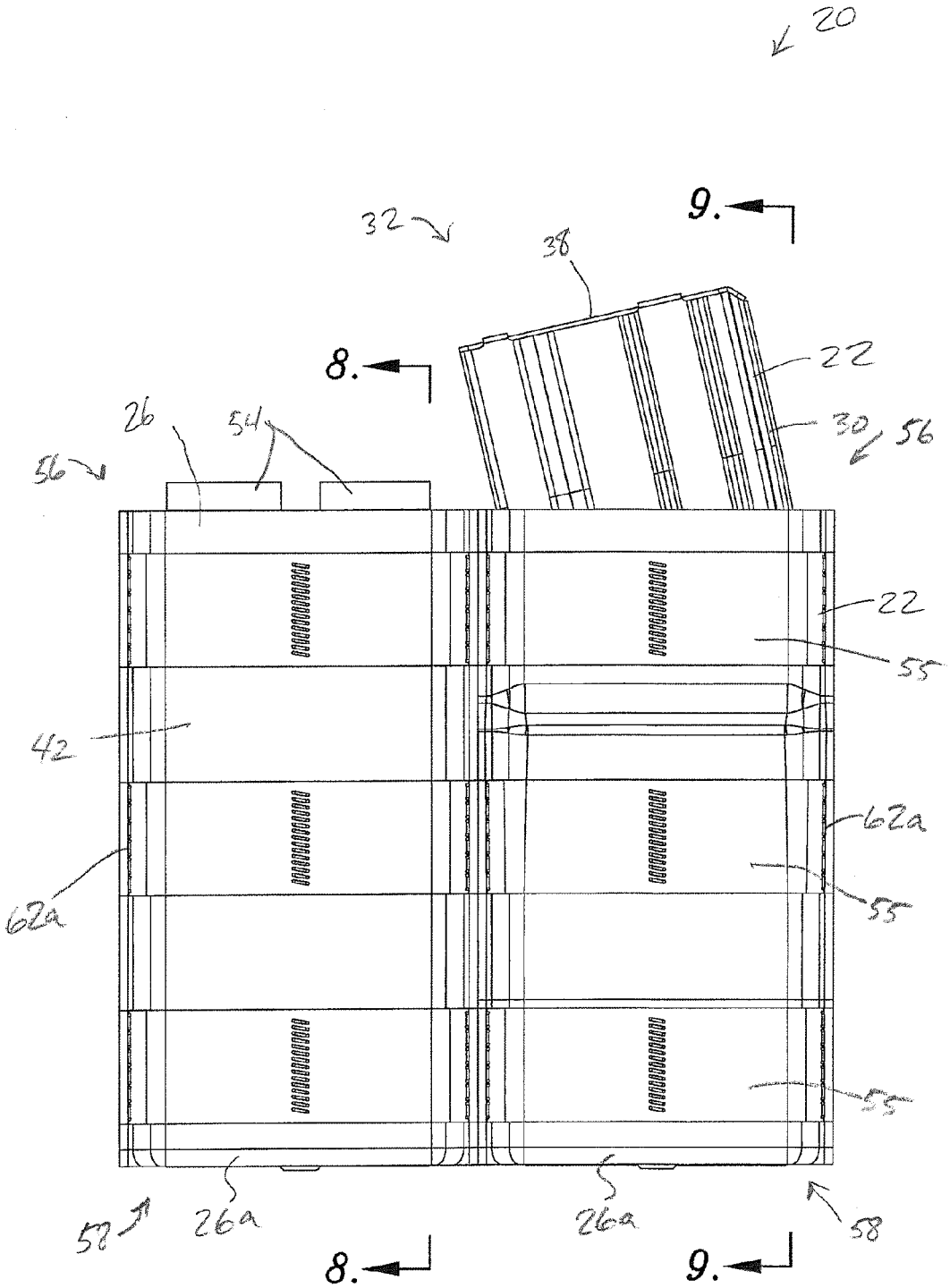
Figure 8:
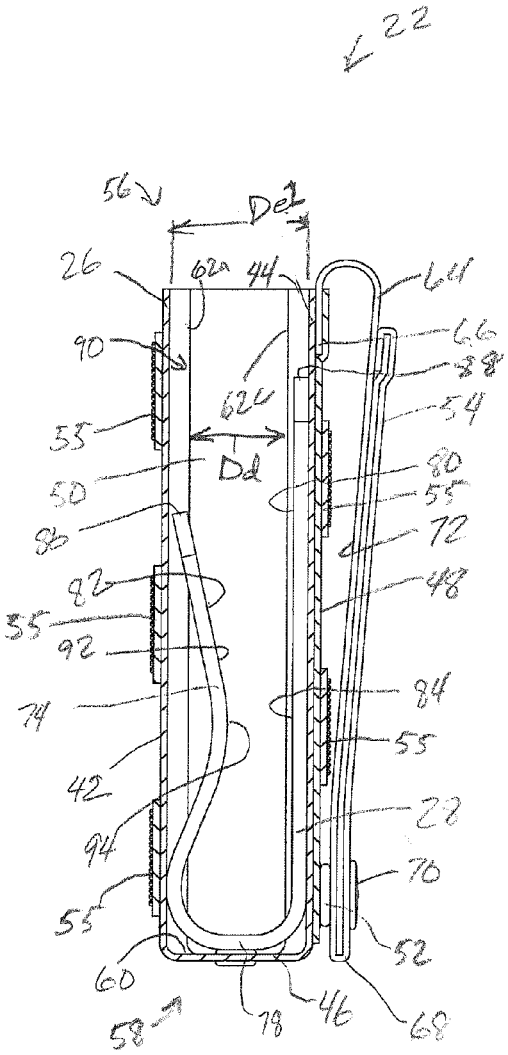
Figure 9:
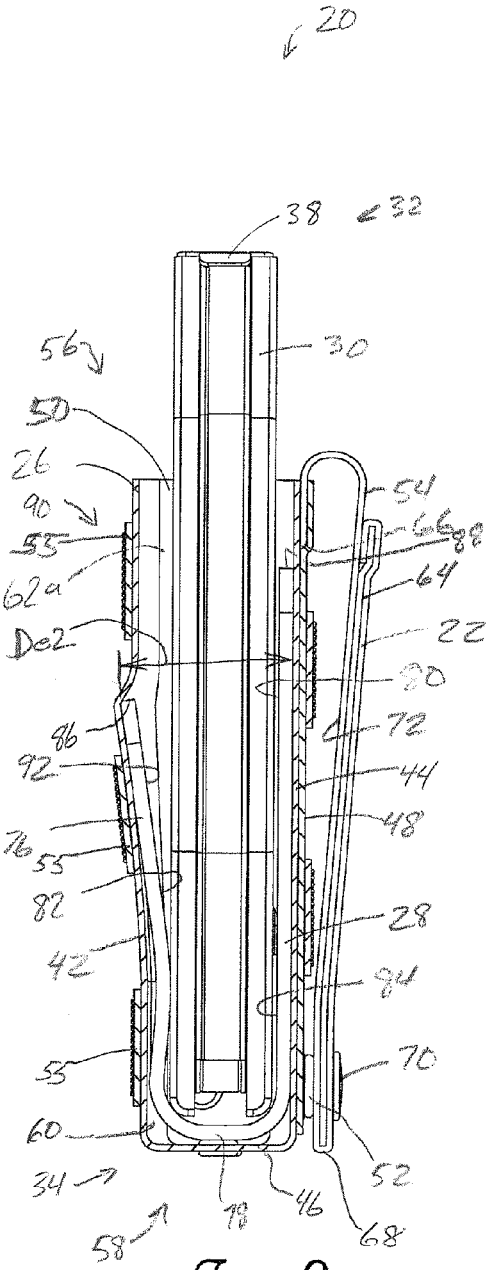
Figure 12:
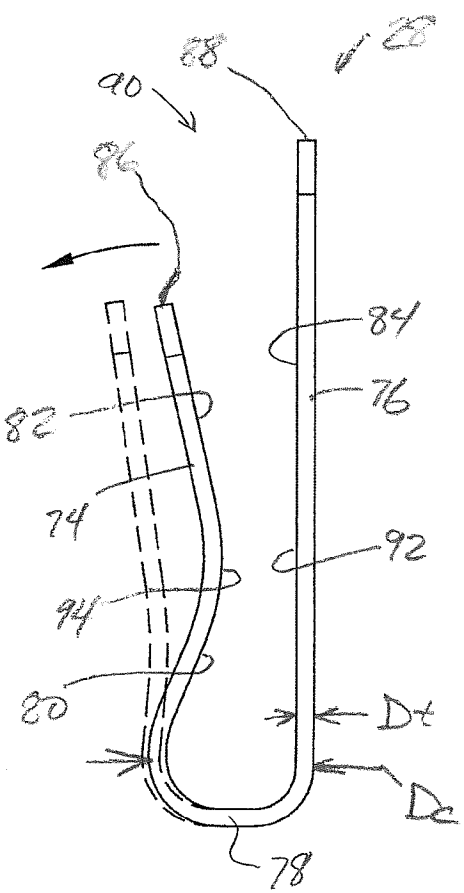
Figure 11:
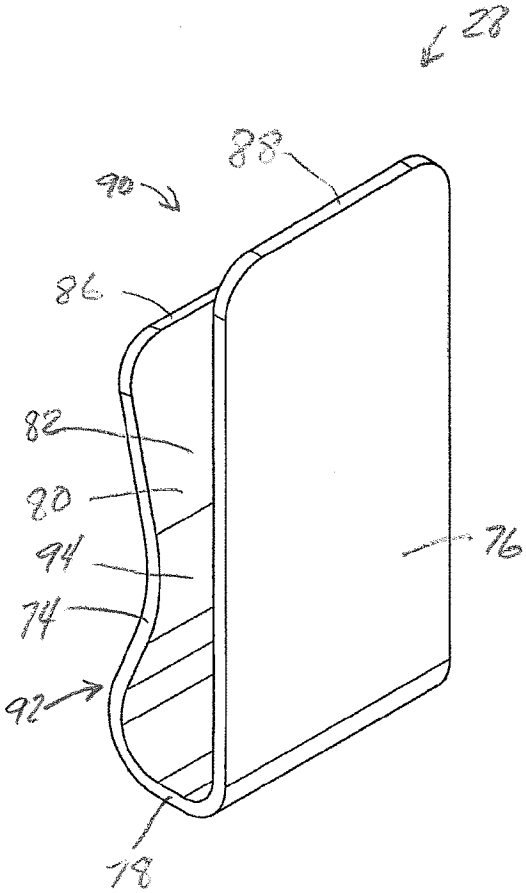
Figure 10:
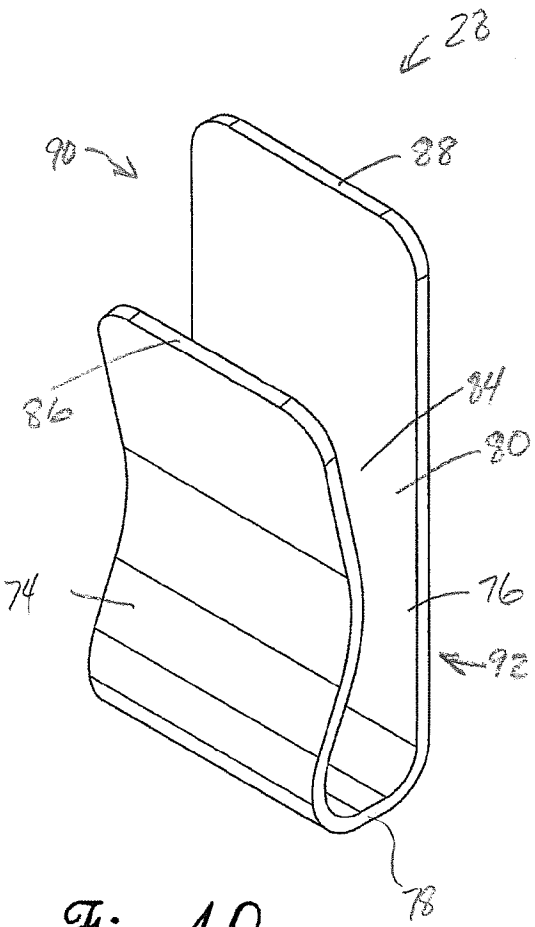

FIG. 5 is a front perspective of a magazine assembly constructed in accordance with a preferred embodiment of the present invention, with the magazine assembly including a magazine pouch that presents a pair of pouch slots, expandable clips inserted within the pouch slots, and a pair of magazines operable to hold ammunition, where a first magazine is inserted with a first clip into a first pouch slot and a second clip is inserted into a second pouch slot but with the second magazine removed from the second pouch slot;

FIG. 6 is a rear perspective of the magazine assembly shown in FIG. 5;

FIG. 7 is a fragmentary front elevation of the magazine assembly shown in FIGS. 5 and 6, showing only the first magazine inserted into the magazine pouch;

FIG. 8 is a cross section of the magazine assembly taken along line 8-8 in FIG. 7, showing the second pouch slot with a second expandable clip inserted therein and the second magazine removed, with the expandable clip shown in a relaxed condition;

FIG. 9 is a cross section of the magazine assembly taken along line 9-9 in FIG. 7, showing the first pouch slot with the first expandable clip and the first magazine inserted therein, with the expandable clip shown in a holding condition;

FIG. 10 is a front perspective of the expandable clip shown in FIGS. 8 and 9, with the clip including front and back fingers that meet along a lower end margin to form a hinge element;

FIG. 11 is a rear perspective of the expandable clip shown in FIGS. 8-10; and FIG. 12 is a side elevation of the expandable clip shown in FIGS. 8-11, showing the front finger shiftable relative to the back finger from the relaxed condition to the holding condition.

The drawing figures do not limit the present invention to the specific embodiments disclosed and described herein. The drawings are not necessarily to scale, emphasis instead being placed upon clearly illustrating the principles of the preferred embodiment.

DETAILED DESCRIPTION OF THE PREFERRED EMBODIMENTS

Turning initially to FIGS. 5 and 6, a magazine assembly 20 is constructed in accordance with a preferred embodiment of the present invention. The magazine assembly 20 includes a magazine holder 22 and conventional magazines 24 that each hold multiple rounds of ammunition (not shown). The magazine holder 22 preferably is used by an individual to provide robust support for at least one magazine 24 while permitting efficient access to the magazine 24. It is also within the ambit of the present invention where the magazine holder 22 is constructed to hold an alternative magazine. Furthermore, the illustrated magazine holder 22 could be constructed to securely carry a device other than a magazine. The magazine holder 22 broadly includes a magazine pouch 26 and a pair of expandable clips 28.

Each magazine 24 is conventional and includes an elongated tubular body 30 that presents opposite ends 32,34 and a magazine chamber 36 operable to receive rounds of ammunition (not shown). The magazine 24 also includes an end plate 38, a follower 40, and an internal spring (not shown). The end plate 38 is secured to the tubular body 30 to enclose the end 32. In the usual manner, the spring and follower 40 are slidably mounted in the chamber 36. The spring urges the follower 40 toward the end 34 of tubular body 30. In this manner, rounds within the chamber 36 are urged toward the end 34 by the spring and follower 40. Again, the principles of the present invention are applicable where the magazine 24 has an alternative configuration.

Turning to FIGS. 5-9, the magazine pouch 26 preferably includes an elongated pouch wall structure that defines front and back panels 42,44 integrally formed with a bottom panel 46. The magazine pouch 26 also preferably includes a back reinforcement panel 48, a pair of side panels 50, snap connectors 52, securement loops 54, and lateral reinforcement straps 55.

Each of the side panels 50 also preferably comprises an elongated wall structure. The side panels 50 are attached to respective side margins of the panels 42,44,46,48. Each set of panels 42,44,46,48,50 cooperatively form one of a pair of interconnected side-by-side pouches 26*a*. The panels 42,44, 46,48,50 also cooperatively form open and closed ends 56,58 of the respective pouch 26*a* and a pouch slot 60 that extends between the open and closed ends 56,58.

The illustrated panels 42,44,46,48,50 are preferably formed of a resilient fabric material that includes a synthetic resin. However, the principles of the present invention are applicable where the panels 42,44,46,48,50 have an alternative material construction, such as a continuous wall. The panels 42,44,46,48 are preferably attached to the side panels 50 along seams 62*a,b,c* where the panels 42,44,46,48,50 are sewn together, although the panels 42,44,46,48,50 could be alternatively interconnected. Thus, the panels 42,44,46,48,50 cooperatively provide a pouch arrangement that is flexible. The panels cooperatively form a pocket that extends continuously and endlessly around each pouch slot 60. However, it is within the scope of the present invention where the panels present one or more openings spaced between the open and closed ends 56,58, where the one or more openings permits access to the pouch slot 60.

The snap connectors 52 are preferably sewn and thereby secured to the panels 44,48 (see FIGS. 8 and 9). As will be discussed, the connectors 52 are removably attached to connectors of the loops 54.

Again, the illustrated magazine pouch 26 preferably forms a pair of interconnected side-by-side pouches 26*a* that each present one of the pouch slots 60. However, the magazine pouch 26 could also form a single pouch 26*a* or more than two pouches 26*a* arranged side-by-side without departing from the scope of the present invention.

The illustrated pouch slot 60 preferably defines a slot depth dimension Dd (see FIG. 8) and a slot width dimension Dw (see FIG. 5). The slot depth dimension Dd generally coincides with the distance between the seams 62*a,c* when the clip 28 is removed from the pouch slot 60. As will be shown, the clip 28 preferably serves to expand the magazine pouch 26 so as to increase the slot depth dimension Dd when the clip 28 is inserted into the pouch slot 60.

Turning to FIGS. 8 and 9, the loops 54 each include an elongated strap 64 presenting opposite ends 66,68 and a snap connector 70 mounted adjacent to end 68 of the strap 64. The other end 66 of the strap 64 is sewn between the back panel 44 and the back reinforcement panel 48. The strap 64 is attached so that the snap connector 70 can be removably attached to corresponding snap connector 52, with the loops 54 and panel 48 cooperatively defining loop openings 72.

In the usual manner, the loops 54 permit attachment of the magazine pouch 26 to the user in a number of configurations. For instance, the magazine pouch 26 can be worn on a belt, a bandolier, suspenders, a girdle, or another item that is fed through the loop openings 72 to support the magazine pouch 26. However, it will be appreciated that the magazine pouch 26 could have a feature other than loops 54 to mount the magazine pouch 26.

Turning to FIGS. 10-12, the expandable clip 28 preferably cooperates with the magazine pouch 26 to secure the magazine 24 in the pouch slot 60. The clip 28 is preferably unitary and includes front and back fingers 74,76 that meet along a lower end margin to form a hinge element 78. The fingers 74,76 cooperatively define a clip slot 80 that extends laterally between opposed front and back gripping surfaces 82,84. The fingers 74,76 also present endmost edges 86,88 that define a top opening 90 in communication with the clip slot 80. The fingers 74,76 further define side openings 92 that communicate with the clip slot 80. The gripping surfaces 82,84 are preferably spaced apart when the clip 28 is in a relaxed condition, although the gripping surfaces 82,84 could contact one another in the relaxed condition. As will be discussed, the fingers 74,76 are shiftable away from one another from the relaxed condition into a holding condition (see FIG. 12).

The back finger 76 preferably is formed so that the back gripping surface 84 is substantially flat. The front finger 74 preferably is formed so that the front gripping surface 82 has a generally convex shape and presents an apex 94. However, it will appreciated that the gripping surfaces 82,84 could present alternative shapes without departing from the scope of the present invention. For instance, one or both of the gripping surfaces 82,84 could include a convex shape, a concave shape, or a concavo-convex shape. As will be discussed, the gripping surfaces 82,84 preferably frictionally engage the magazine 24 when the magazine 24 is inserted in the clip slot 80.

The front and back fingers 74,76 of the clip 28 preferably taper toward one another in a downward direction away from the endmost edges 86,88. The illustrated fingers 74,76 taper up to apex 94 and then diverge from one another downwardly from the apex 94.

The clip 28 is preferably formed of a unitary strip of a synthetic resin material that is formed to present the fingers 74,76. However, it is within the scope of the present invention where an alternative material is used.

The illustrated clip 28 preferably includes both fingers 74,76. However, it is within the scope of the present invention where the clip 28 has an alternative arrangement of fingers. For instance, the clip 28 could comprise a single finger that is attached to the magazine pouch 26 so that the pouch 26 and clip 28 provide respective ones of the opposed gripping surfaces 82,84

The fingers 74,76 form the hinge element 78 so that the hinge element 78 flexes to permit relative shifting movement of the fingers 74,76. For instance, when the magazine 24 is inserted into the clip slot 80 between the fingers 74,76, the magazine 24 urges the fingers 74,76 from the relaxed condition to the holding condition (see FIGS. 8 and 9). The hinge element 78 flexes to permit movement of the fingers 74,76 from the relaxed condition to the holding condition. In this manner, the hinge element 78 serves as a living hinge.

When the hinge element 78 is flexed in the holding condition, the hinge element 78 acts as a spring by urging the fingers 74,76 to return toward the relaxed condition. As a result, the hinge element 78 operates to urge the fingers 74,76 toward one another so that the fingers 74,76 cooperatively grip the magazine 24. That is, the fingers 74,76 preferably apply a gripping force to the magazine 24 and frictionally retain the magazine 24. When the magazine 24 is removed from the clip slot 80, the hinge element 78 urges the fingers 74,76 to return to the relaxed condition.

It is also within the scope of the present invention where the clip 28 has an alternative hinge arrangement. While the illustrated clip 28 preferably presents a thickness dimension Dt (see FIG. 12) that is substantially continuous along the fingers 74,76 and hinge element 78, the hinge element 78 could present a laterally extending groove that forms a line of weakness between the fingers 74,76 so that the hinge element 78 forms a living hinge. Also the hinge element 78 could be formed by an alternative spring that permits flexing between the fingers 74,76 and urges the fingers 74,76 to return to the relaxed condition.

Alternatively, the clip 28 could include a pair of discrete mating hinge members pivotally attached to one another (e.g., with a pin) to form a pivot joint. This alternative construction could also include a discrete spring (such as a torsion spring) that interconnects the hinge members and urges the hinge members into the relaxed condition.

The expandable clip 28 is preferably slidably mounted in the pouch slot 60 so that the clip 28 can be selectively inserted and removed from the pouch slot 60. When inserted, the hinge element 78 is preferably positioned along the bottom of the pouch 26 so that the clip slot 80 extends upwardly from the hinge element 78 and is exposed to the open end 56. Furthermore, the gripping surfaces 82,84 extend along opposite sides of the pouch slot 60.

The clip 28 preferably presents a clip depth dimension Dc (see FIG. 12) larger than the slot depth dimension Dd when the pouch slot 60 is empty. When the clip 28 is mounted in the pouch slot 60, the fingers 74,76 cooperatively expand the pouch 26 so that slot depth is enlarged to an expanded dimension De1 (see FIG. 8). In particular, the relative flexibility of the panels 42,44,46,48,50 and the straps 55 permits the pouch 26 to be expanded by the clip 28. When expanded, the panels 42,44,46,48,50 and straps 55 are tensioned so as to be taut around the clip 28. Consequently, the illustrated clip 28 is retained within the pouch slot 60 solely by frictional engagement with the panels 42,44,50.

It is also within the ambit of the present invention where the illustrated magazine holder 22 has an alternative arrangement to removably secure the clip 28 within the pouch slot 60. For instance, clip 28 and pouch 26 could each have connectors that are removably attached to each other. For some aspects of the present invention, the clip 28 could also be permanently secured within the pouch slot 60.

Turning to FIGS. 7 and 9, when the clip 28 is inserted into the pouch slot 60 and the magazine 24 is received between the fingers 74,76, the magazine 24 shifts the fingers 74,76, panels 42,44,46,48,50, and straps 55 from the relaxed condition to the holding condition. In the holding condition, the fingers 74,76 further expand the pouch 26 so that slot depth Dd is further enlarged to an expanded dimension De2 greater than expanded dimension De1 (see FIGS. 8 and 9). Again, the relative flexibility of the panels 42,44,46,48,50 and the straps 55 permits the pouch 26 to be further expanded by the clip 28, with the tension in the panels 42,44,46,48,50 and straps 55 being further increased. When receiving the magazine 24 in the holding condition, the clip depth dimension Dc has a maximum finger separation depth greater than when the clip 28 is in the relaxed condition. The maximum finger separation depth is equivalent to the expanded dimension De2 and is also greater than the slot depth dimension Dd and the expanded dimension De1.

The endmost edge 86 of the front finger 74 preferably frictionally engages the pouch 26 in the holding condition. Furthermore, the endmost edge 86 preferably points upwardly so that the endmost edge 86 provides greater frictional resistance to clip removal compared to frictional resistance associated with clip insertion.

The magazine 24 is preferably retained within the pouch slot 60 solely by frictional engagement with the clip 28, but with the pouch 26 and clip 28 cooperatively providing the gripping force. As discussed above, when the magazine 24 is located between the fingers 74,76, the hinge element 78 urges the fingers 74,76 toward one another so that the fingers 74,76 cooperatively grip the magazine 24. The panels 42,44,46,48,50 and straps 55 also provide gripping force because the panels 42,44,46,48,50 and straps 55 are stretched by the clip 28 and the magazine 24.

The expandable clip 28 is preferably inserted and supported within the pouch slot 60. However, it is within the ambit of the present invention where the clip 28 is alternatively mounted to grip the magazine 24. For instance, the clip 28 could be secured outside of panels 42,44,46,48,50 so that the panels 42,44,46,48,50 are received within the clip slot 80. As a result, the panels 42,44 would present corresponding gripping surfaces 82,84. In such a configuration, the clip 28 could be permanently attached to the magazine pouch 26 or could be removably attached thereto.

In use, the clips 28 are inserted into respective pouch slots 60 so that the hinge element 78 is located adjacent the bottom panel 46. Each magazine 24 is then inserted into a corresponding one of the clip slots 80 so that the end 34 is positioned adjacent the hinge element 78. The hinge element 78 flexes to permit shifting of the fingers 74,76 from the relaxed condition to the holding condition by magazine insertion. At the same time, the panels 42,44,46,48,50 and straps 55 expand in response to shifting of the fingers 74,76 into the holding condition. In this manner, the magazine pouch 26 and clip 28 cooperatively grip the held magazine 24, with the clip 28 frictionally engaging the magazine 24 to restrict magazine removal.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. A magazine holder operable to hold a small arms magazine, said magazine holder comprising:

a flexible magazine pouch presenting an elongated pouch slot operable to receive at least part of the magazine when the magazine pouch holds the magazine, with the magazine pouch being operable to extend at least partly around the held magazine and defining a slot length and a slot depth transverse to the slot length; and a shiftable gripping device including a pair of opposite fingers, with the gripping device being slidably inserted in the pouch slot so that the fingers extend along the slot length, said gripping device being shiftable into and out of an empty condition where the pouch does not receive the magazine, with the gripping device tensioning the pouch so that the pouch frictionally retains the gripping device in the pouch slot, said gripping device being shiftable with the pouch to receive the held magazine in a holding condition where the slot depth is enlarged from the empty condition and tension in the pouch is increased, said magazine holder presenting opposite gripping surfaces that extend along opposite sides of the pouch slot to contact the held magazine in the holding condition, said fingers urging the gripping surfaces against the held magazine in the holding condition so that the gripping surfaces cooperatively grip the magazine.

2. The magazine holder as claimed in claim 1, said gripping device including a hinge element that interconnects the fingers and permits movement of the fingers relative to one another along a separation direction, said hinge element permitting the fingers to be shifted between the holding condition and the empty condition, said fingers being moved away from one another when shifted from the empty condition to the holding condition.

3. The magazine holder as claimed in claim 2, said hinge element including a spring that interconnects the fingers, with the hinge element urging the fingers toward the empty condition when in the holding condition.

4. The magazine holder as claimed in claim 3, said hinge element being integrally formed with the fingers, with the gripping device being unitary.

5. The magazine holder as claimed in claim 2, said pouch slot extending between an open end and a closed end of the magazine pouch, said hinge element being positioned adjacent the closed end.

6. The magazine holder as claimed in claim 5, one of said fingers presenting an endmost edge and tapering toward the other one of the fingers in a direction away from the endmost edge, said endmost edge frictionally engaging the pouch in the holding condition.

7. The magazine holder as claimed in claim 6, said one finger projecting toward the open end to present the endmost edge.

8. The magazine holder as claimed in claim 7, said endmost edge being closer to the open end than to the closed end when the hinge element engages the closed end.

9. The magazine holder as claimed in claim 2, said hinge element being positioned adjacent the closed end, said fingers presenting the gripping surfaces, said fingers cooperatively defining an elongated magazine slot therebetween.

10. The magazine holder as claimed in claim 2, said hinge element being positioned adjacent the closed end, said slot depth being measured along the separation direction, with the slot depth having a relaxed slot depth dimension associated with removal of the gripping device from the pouch, said fingers cooperatively defining a maximum finger separation dimension of the gripping device, where the maximum finger separation dimension is larger than the relaxed slot depth dimension when the gripping device is in the holding condition so that the fingers expand the pouch in the holding condition, with the pouch urging the fingers toward the empty condition.

11. The magazine holder as claimed in claim 10, said gripping device in the empty condition being larger than the relaxed slot depth dimension so that the fingers expand the pouch in the empty condition.

12. The magazine holder as claimed in claim 10, one of said fingers presenting an endmost edge and tapering toward the other one of the fingers in a direction away from the endmost edge, said endmost edge frictionally engaging the pouch in the holding condition.

13. The magazine holder as claimed in claim 10, said hinge element including a spring that interconnects the fingers, with the hinge element urging the fingers toward the relaxed condition when in the holding condition.

14. The magazine holder as claimed in claim 13, said hinge element being integrally formed with the fingers, with the gripping device being unitary.

15. The magazine holder as claimed in claim 2, said pouch slot extending between an open end and a closed end of the magazine pouch, said the hinge element being positioned adjacent the closed end, said fingers cooperatively defining an elongated magazine slot therebetween, said fingers cooperatively defining side openings that communicate with the magazine slot so that the magazine can extend laterally into and out of the magazine slot.

16. The magazine holder as claimed in claim 15, said pouch slot defining a minimum lateral slot dimension measured transverse to the separation direction, said gripping device presenting a maximum lateral grip dimension less than the minimum lateral slot dimension.

17. The magazine holder as claimed in claim 2, said hinge element being positioned adjacent the closed end, one of said fingers presenting an endmost edge that frictionally engages the pouch in the holding condition to restrict sliding removal of the gripping device from the pouch.

18. The magazine holder as claimed in claim 17, said magazine pouch including an upright panel that extends along and at least partly defines the pouch slot, with the pouch slot extending between an open end and a closed end of the magazine pouch, said magazine pouch further including a lateral reinforcement strap engaging the panel, said endmost edge engaging the panel below the lateral reinforcement strap.

19. The magazine holder as claimed in claim 18, said one finger presenting a curved shape, with the other one of the fingers presenting a substantially flat shape.

* * * * *